US007921834B2

(12) United States Patent
Hamilton

(10) Patent No.: US 7,921,834 B2
(45) **Date of Patent: *Apr. 12, 2011**

(54) PAINTBALL LOADER

(75) Inventor: Jared L. Hamilton, Chico, CA (US)

(73) Assignee: Ancient Innovations Corporation, Redding, CA (US)

( * ) Notice: Subject to any disclaimer, the term of this patent is extended or adjusted under 35 U.S.C. 154(b) by 1373 days.

This patent is subject to a terminal disclaimer.

(21) Appl. No.: 11/317,738

(22) Filed: Dec. 23, 2005

(65) Prior Publication Data

US 2006/0130821 A1 Jun. 22, 2006

Related U.S. Application Data

(63) Continuation-in-part of application No. 10/391,942, filed on Mar. 19, 2003, now Pat. No. 6,978,776.

(51) Int. Cl.
*F41B 11/02* (2006.01)

(52) U.S. Cl. ..... 124/51.1; 124/48; 124/52; 221/277

(58) Field of Classification Search ..... 42/49.01; 89/33.02, 33.17; 124/45, 48, 51.1, 52; 221/258, 221/277

See application file for complete search history.

(56) References Cited

U.S. PATENT DOCUMENTS

| | | | | |
|---|---|---|---|---|
| 3,715,055 | A * | 2/1973 | Kendrick et al. | 221/75 |
| 4,025,071 | A * | 5/1977 | Hodges | 473/436 |
| 4,965,951 | A * | 10/1990 | Miller et al. | 42/49.01 |
| 5,335,579 | A * | 8/1994 | David | 89/34 |
| 5,520,171 | A * | 5/1996 | David | 124/51.1 |
| 5,542,570 | A * | 8/1996 | Nottingham et al. | 221/192 |
| 5,709,199 | A * | 1/1998 | Johnson et al. | 124/69 |
| 5,816,444 | A * | 10/1998 | David | 221/289 |
| 5,954,042 | A * | 9/1999 | Harvey | 124/51.1 |
| 6,109,252 | A * | 8/2000 | Stevens | 124/51.1 |
| 6,327,953 | B1 * | 12/2001 | Andresen | 89/33.17 |
| 6,415,781 | B1 * | 7/2002 | Perrone | 124/51.1 |
| 6,467,473 | B1 * | 10/2002 | Kostiopoulos | 124/51.1 |
| 6,915,792 | B1 * | 7/2005 | Sheng | 124/48 |
| 6,978,776 | B2 * | 12/2005 | Hamilton | 124/51.1 |

FOREIGN PATENT DOCUMENTS

WO WO 81/03432 * 12/1981

* cited by examiner

*Primary Examiner* — John Ricci
(74) *Attorney, Agent, or Firm* — Douglas L. Weller

(57) ABSTRACT

Paintballs are loaded into a paintball gun. The paintballs are stored within a drive tube of a paintball loader. The paintballs are loaded into the paintball gun from the drive tube of the paintball loader. A screw is rotated with respect to the drive tube so that the paintballs are constrained to travel along a helical groove of the screw and along one of multiple column grooves on an inner surface of the drive tube.

18 Claims, 17 Drawing Sheets

FIG. 4
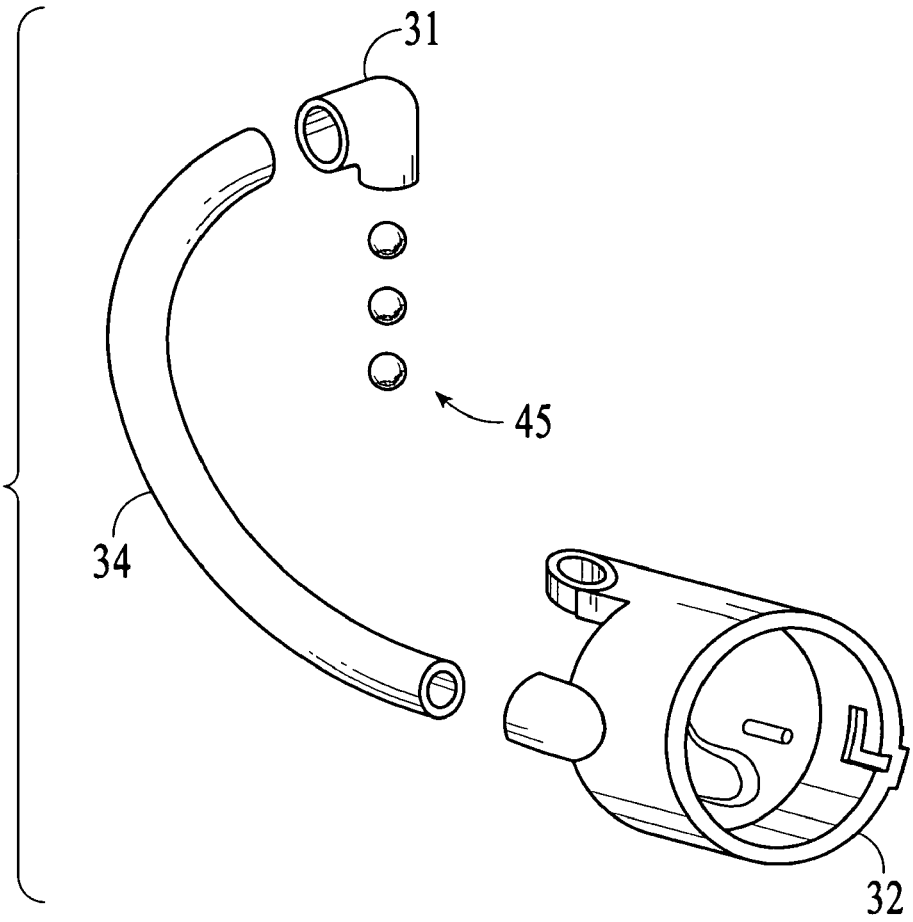
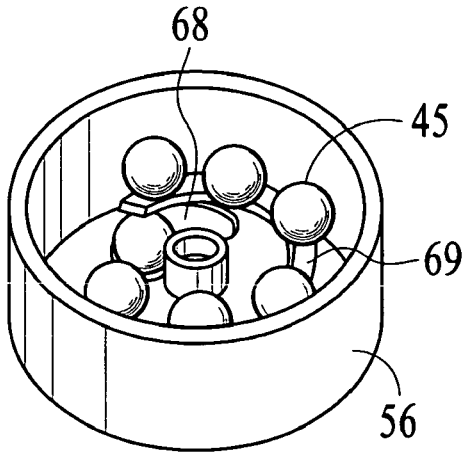
FIG. 6

PAINTBALL LOADER

CROSS REFERENCE TO RELATED APPLICATION

This application is a continuation-in-part of application Ser. No. 10/391,942, filed Mar. 19, 2003 now U.S. Pat. No. 6,978,776.

BACKGROUND

Paintball guns are used in games where participants fire at one another projectiles consisting of paint enclosed in an outer layer composed of gel. The paintball guns use pressurized gas to propel paintballs towards an intended target.

Generally, paintballs are stored in a bulk loader. The bulk loader typically sits on top of the paintball gun and utilizes gravity to feed paintballs into the barrel of paintball gun in preparation for firing at a target. Paintball guns are typically semiautomatic and can be fired as fast as a user can pull a trigger. It is necessary, therefore, for bulk loaders to allow for quick and consistent loading of paintballs.

It is not unusual for paint ball guns to occasionally jam during operation. This can often be remedied, for example by a user shaking the gun upon detecting that a jam has occurred. Alternatively, efforts have been made to place anti-jamming devices within paintball loaders. See, for example, U.S. Pat. No. 5,282,454 issued to Roderick L. Bell, et al. on Feb. 1, 1994 and U.S. Pat. No. 6,415,781 B1 issued to Aldo Perrone on Jul. 9, 2002.

SUMMARY OF THE INVENTION

In accordance with an embodiment of the present invention, paintballs are loaded into a paintball gun. The paintballs are stored within a drive tube of a paintball loader. The paintballs are loaded into the paintball gun from the drive tube of the paintball loader. A screw is rotated with respect to the drive tube so that the paintballs are constrained to travel along a helical groove of the screw and along one of multiple column grooves on an inner surface of the drive tube.

BRIEF DESCRIPTION OF THE DRAWINGS

FIG. 4 shows a disassembled paintball transportation system in accordance with an embodiment of the present invention.

FIG. 6 shows paintballs arranged in an outer cap of a paintball clip in accordance with an embodiment of the present invention.

DESCRIPTION OF EMBODIMENTS OF THE INVENTION

Figure 1:
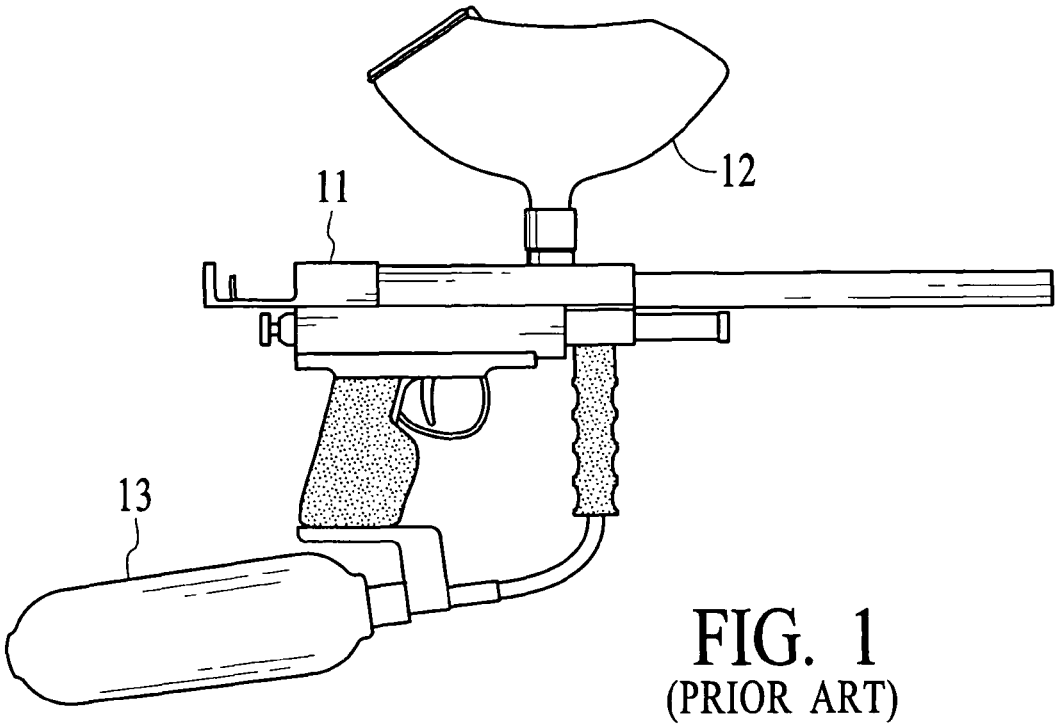
FIG. 1 (PRIOR ART)
FIG. 1 shows an example of a paintball gun with a prior art bulk loader.

FIG. 1 is a simplified block diagram of a prior art paintball gun 11. Paintball gun 11 is equipped with a compressed air container 13 used to supply power to propel paintballs towards a target. Paintballs are stored in a bulk loader 12.

Figure 2:
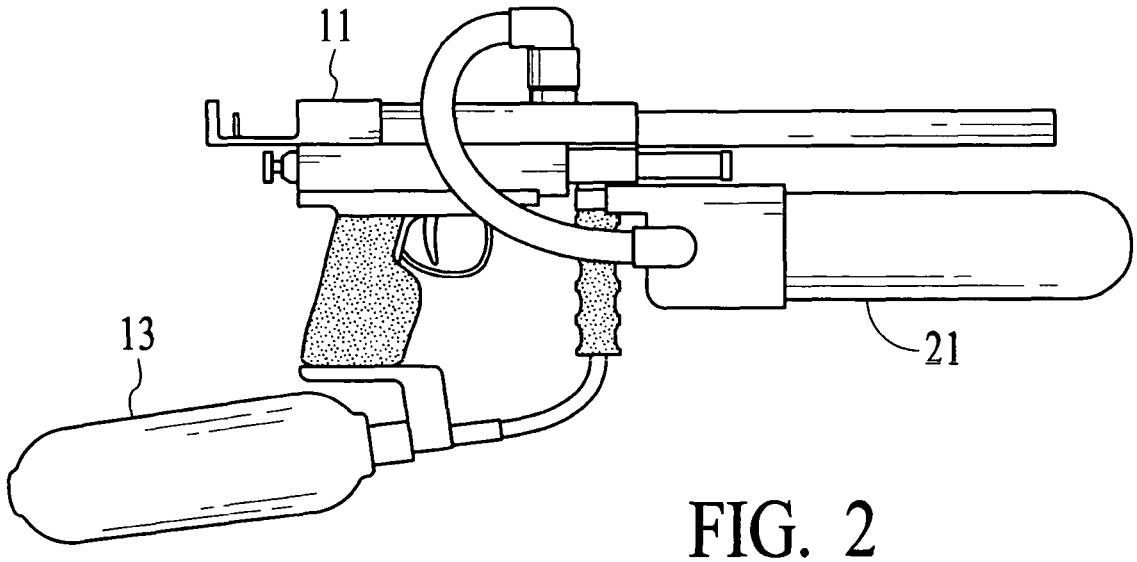
FIG. 2 shows a paintball gun with a paintball loader in accordance with an embodiment of the present invention.

FIG. 2 shows bulk loader 12 being replaced with a paintball loader 21, attached as shown.

Figure 3:
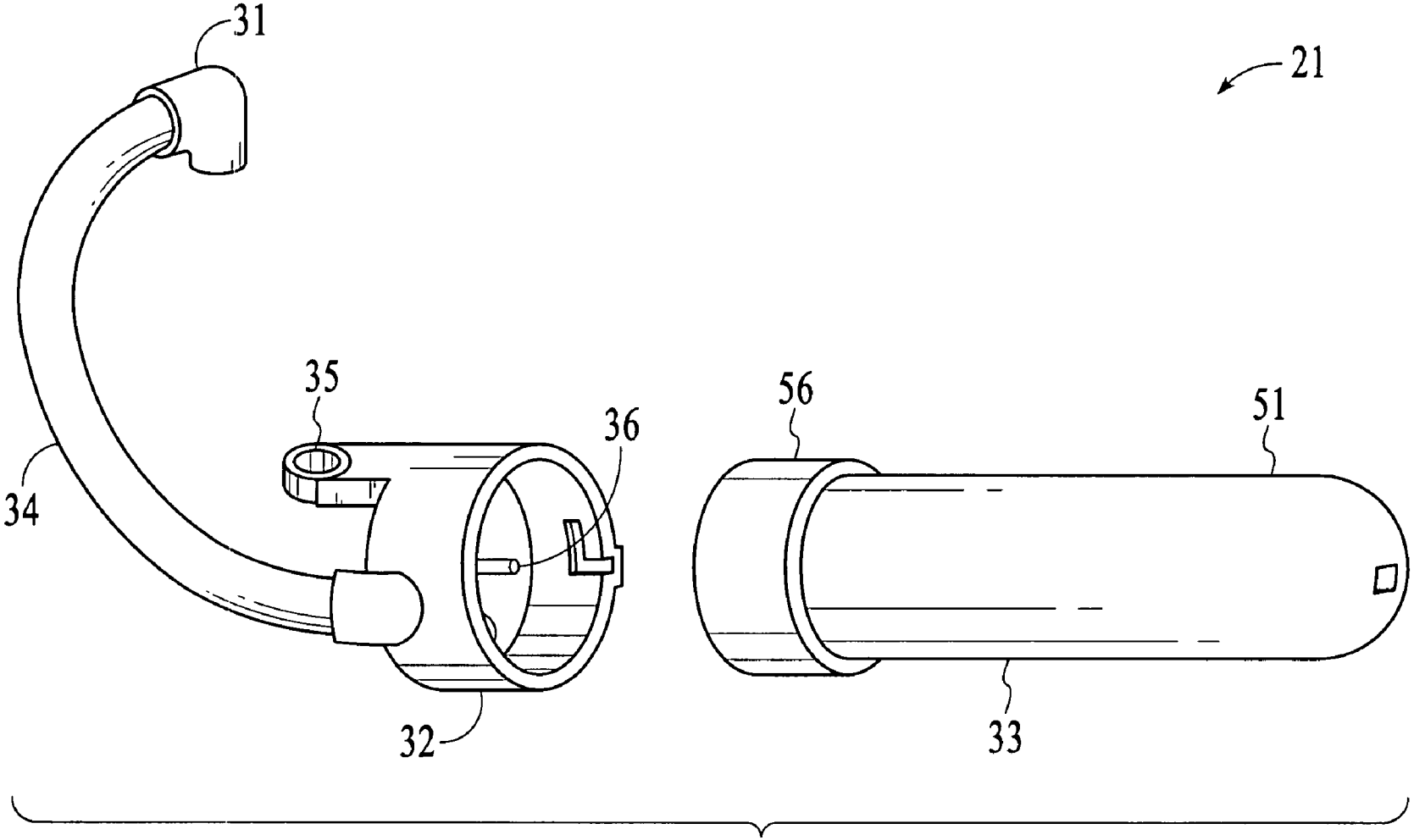
FIG. 3 shows an assembled paintball clip separated from a paintball transportation system in accordance with an embodiment of the present invention.

Paintball loader 21 is shown in FIG. 3. An attachment mechanism 35 is used to physically secure paintball loader 21 to paintball gun 11. Paintballs are stored in a paintball clip 33. During a firing session, paintballs exit paintball clip 33 and travel through a delivery tube 34 before loaded through an elbow joint 31 into paintball gun 11. A clip holder 32 secures paintball clip 33 in place during use. Clip holder 32 has a quick release to allow quick and efficient exchange of paintball clips. As further discussed below, a pin 36 within clip holder 32 is used to disengage a spring restraint within paintball clip 33 when paintball clip 33 is attached to clip holder 32.

Figure 23:
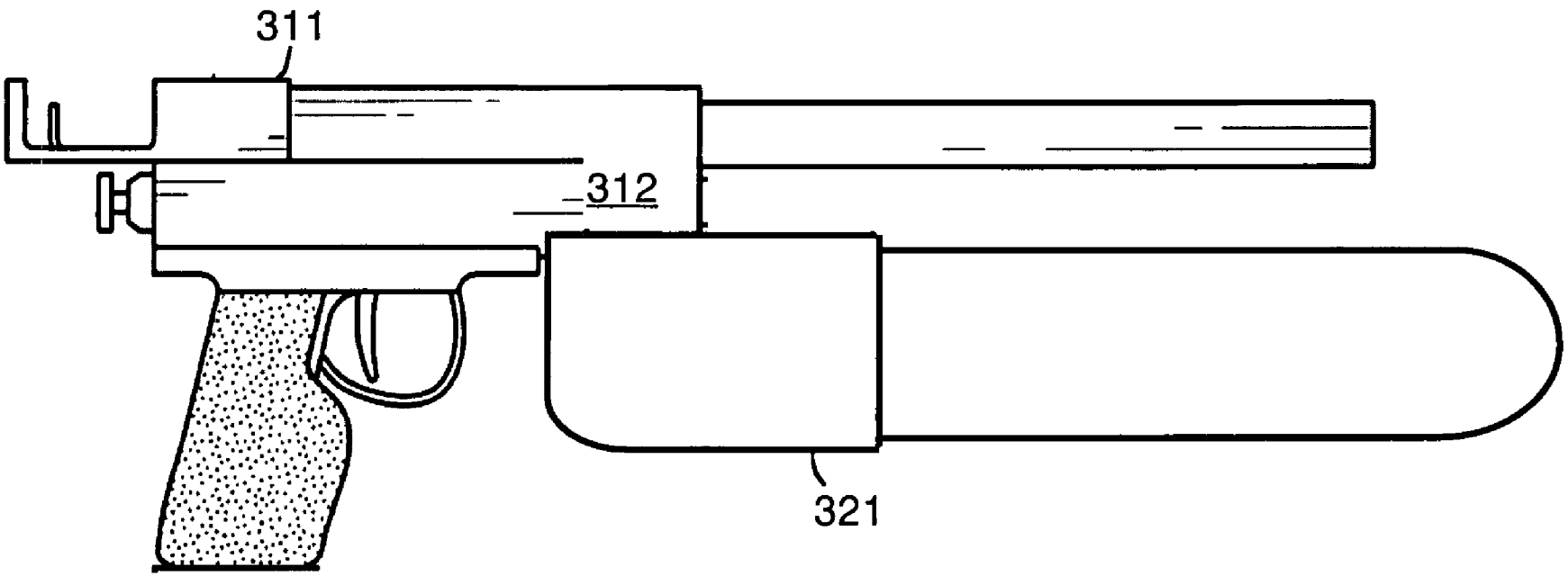
FIG. 23 shows a paintball gun with a paintball loader attached so as to directly load paintballs from below in accordance with an embodiment of the present invention.

In an alternative embodiment illustrated by FIG. 23, a paintball loader 321 is attached to a paintball gun 311 so as to directly load paintballs from below into a paintball reception area 312 of paintball gun 311. This eliminates the need for a delivery tube.

As shown in FIG. 3, the exterior of paintball clip 33 includes an outer cap 56 and a containment tube 51. When paintball clip 33 is attached to clip holder 32, clip holder 32 holds outer cap 56, and thus containment tube 51, firmly, preventing disengagement or rotation of outer cap 56 and containment tube 51.

FIG. 4 shows detail about how delivery tube 34 is attached to elbow joint 31 and clip holder 32. Paintballs 45 are shown as they would exit from elbow joint 31.

Figure 5:
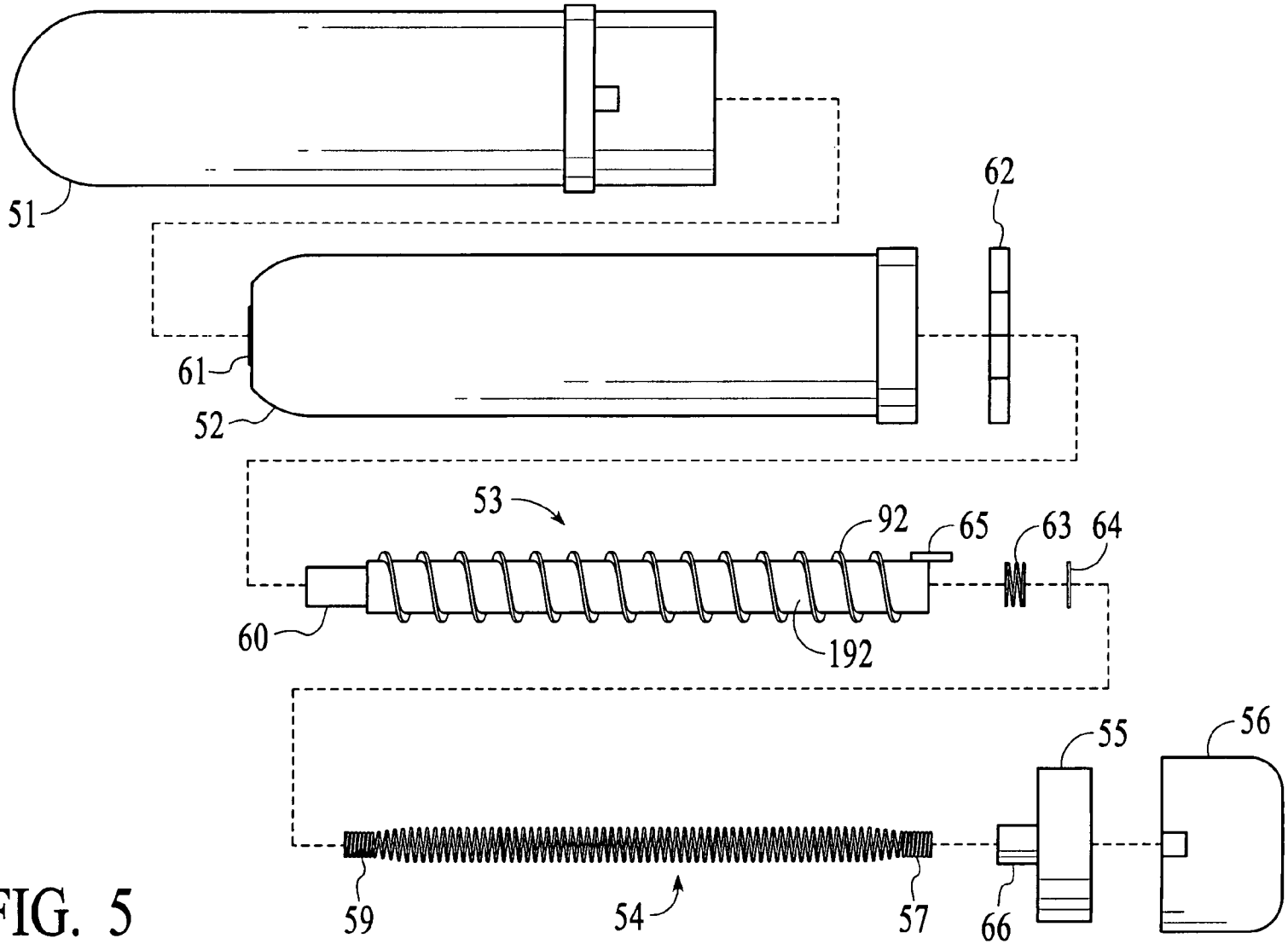
FIG. 5 shows a disassembled paintball clip in accordance with an embodiment of the present invention.

FIG. 5 shows the disassembled parts of paintball clip 21. The parts include a containment tube 51, a drive tube 52, a screw 53, a torsion spring 54, an inner cap 55 and an outer cap 56. Torsion spring 54 is used to store torsion energy. A compression spring 63 is used to store compression energy between screw 54 and thrust bushing 64. Torsion spring 54 is attached to inner cap 55 at a square end 57.

Torsion spring 54 fits within screw 53. When paintball clip 51 is assembled, a square end 59 of torsion spring 54 along with a square shaft 60 of screw 53, extends through a hole 61 in drive tube 52 and is attached to containment tube 51. This anchors screw 53 and square end 59 of torsion spring 54 to containment tube 51. Also, when paintball clip 51 is assembled, inner cap is 55 is attached to drive tube 52 and outer cap 56 is attached to containment tube 51. Screw 53 has a single ridge 92 that forms a single groove (channel) 192 along which paintballs travel until a ridge tip 65 is reached.

When paintball clip 51 is assembled and attached to clip holder 32, pin 36 (shown in FIG. 11) pushes inner cap 52, causing compression spring 63 to compress. The resulting alignment of inner cap 55 to outer cap 56 allows rotation of inner cap 55 and drive tube 52 with respect to outer cap 56 and containment tube 51. Drive tube 52 is driven by the stored torsional energy of torsion spring 54. A rotation limiter 62 allows torsion spring 54 to remain prewound to an initial tension allowing optimal performance of torsion spring 54.

When paintball clip 51 is filled with paintballs, it is the rotation of inner cap 55 and drive tube 52 with respect to outer cap 56 and containment tube 51 that moves paintballs out of paintball clip 51 and into delivery tube 34 (shown in FIG. 4).

FIG. 6 illustrates the path paintballs 45 take when exiting paintball clip 33 through outer cap 56. Paintballs 45 follow ramp 69 around the diameter of outer cap 56 before exiting through a hole 68.

Figure 7:
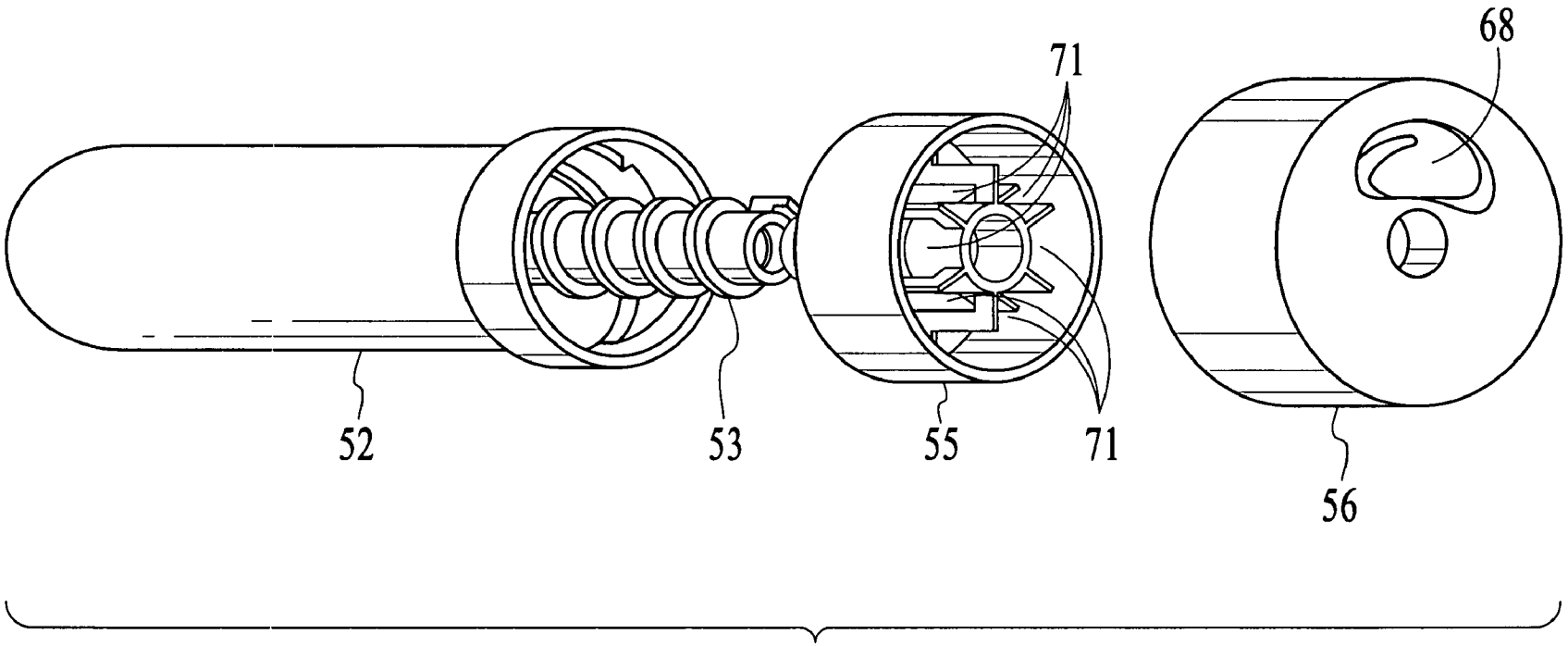
FIG. 7 shows a partially assembled paintball clip in accordance with an embodiment of the present invention.

FIG. 7 shows paintball clip 33 being partially assembled. Within drive tube 52, paintballs 45 travel around screw 53, proceed through one of six openings 71 in inner cap 55 and through 68 within outer cap 56.

Figure 8:
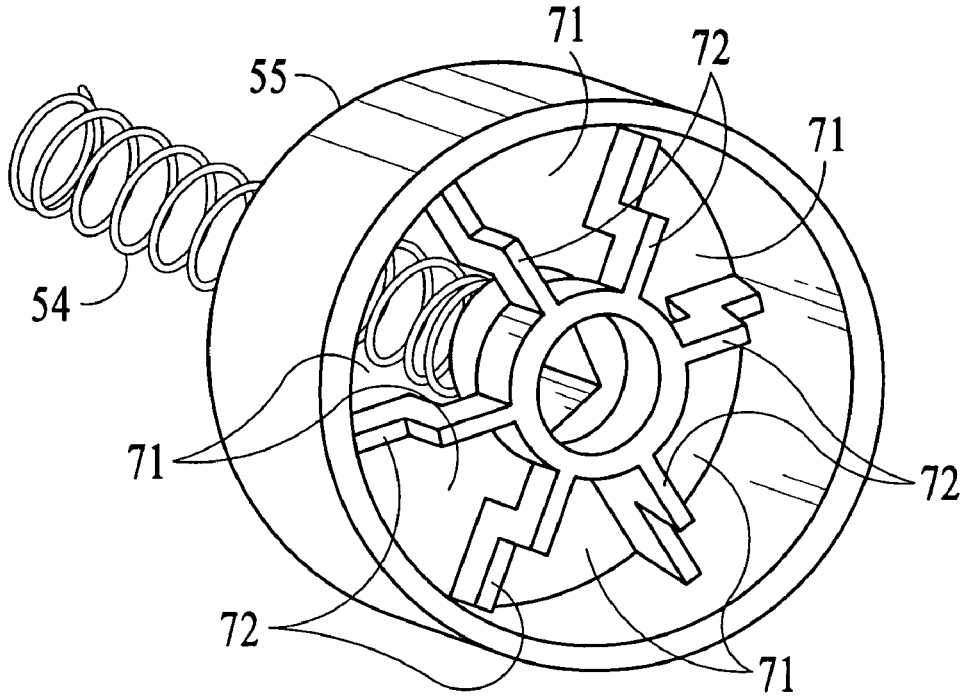
FIG. 8 shows inner cap of a paintball clip attached to a spring in accordance with an embodiment of the present invention.

FIG. 8 shows the arrangement of holes 71 in inner cap 55. Associated with each hole 71 is a flute denoted by ridges 72 which guide paint balls through holes 71.

Figure 9:
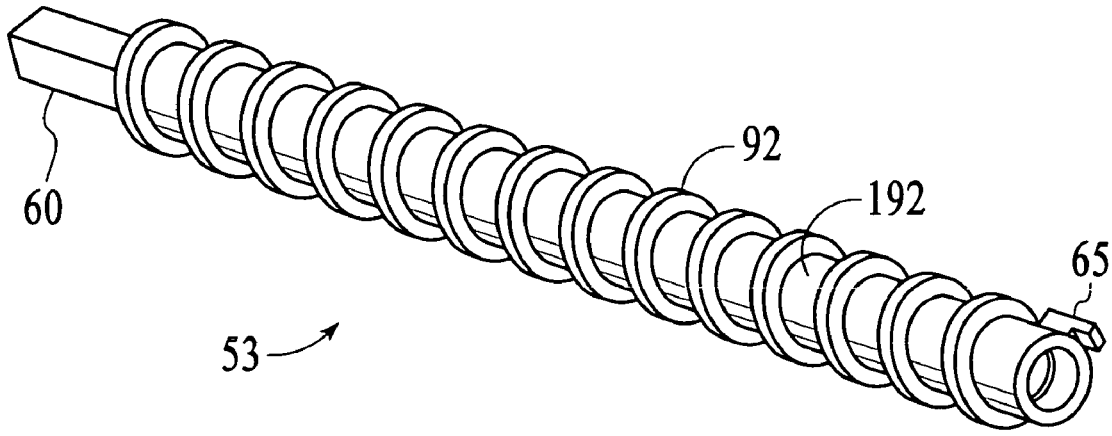
FIG. 9 shows a screw of a paintball clip in accordance with an embodiment of the present invention.

FIG. 9 shows screw 53 having a single ridge 92 forming a single groove (channel) 192 along which paintballs travel. Square shaft 60 and ridge tip 65 are also shown.

Figure 10:
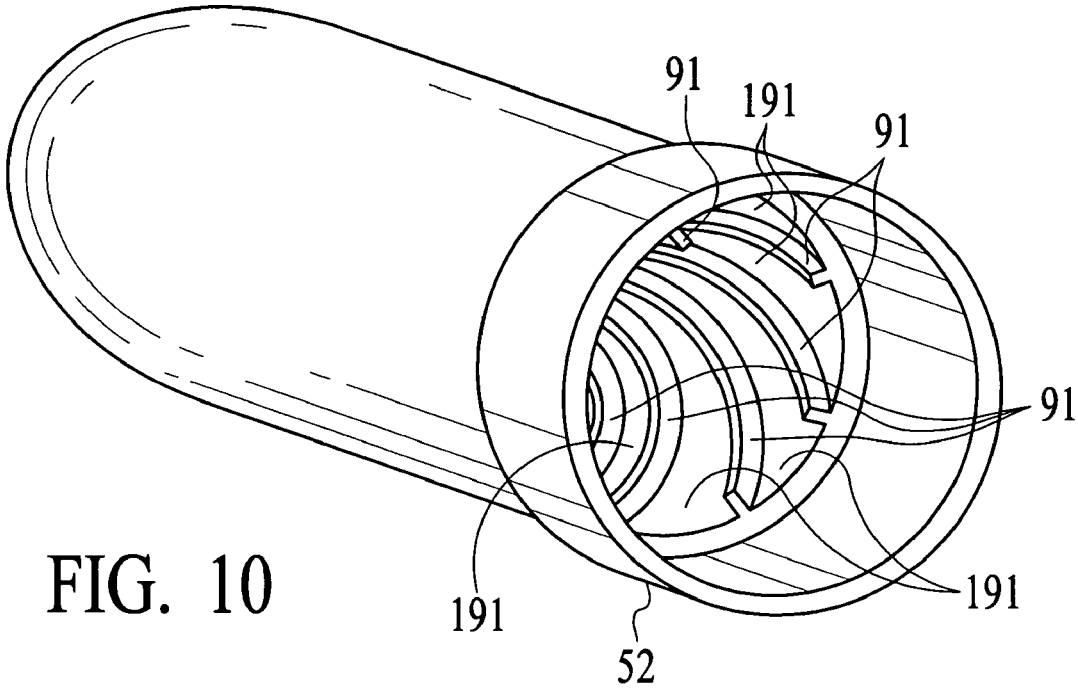
FIG. 10 shows a drive tube of a paintball clip in accordance with an embodiment of the present invention.

FIG. 10 shows drive tube 52 having six inner ridges 91 that form six grooves (channels) 191 along which paintballs travel.

As inner cap 55 (shown in FIG. 5) and drive tube 52 rotate with respect to screw 53 (shown in FIG. 9), outer cap 56 (shown in FIG. 5) and containment tube 51 (shown in FIG. 5), ridges 91 of grooves 191 of inner cap 55 push paintballs 45 (shown in FIG. 7) along groove 192 (shown in FIG. 9) of screw 53 (shown in FIG. 9).

Figure 11:
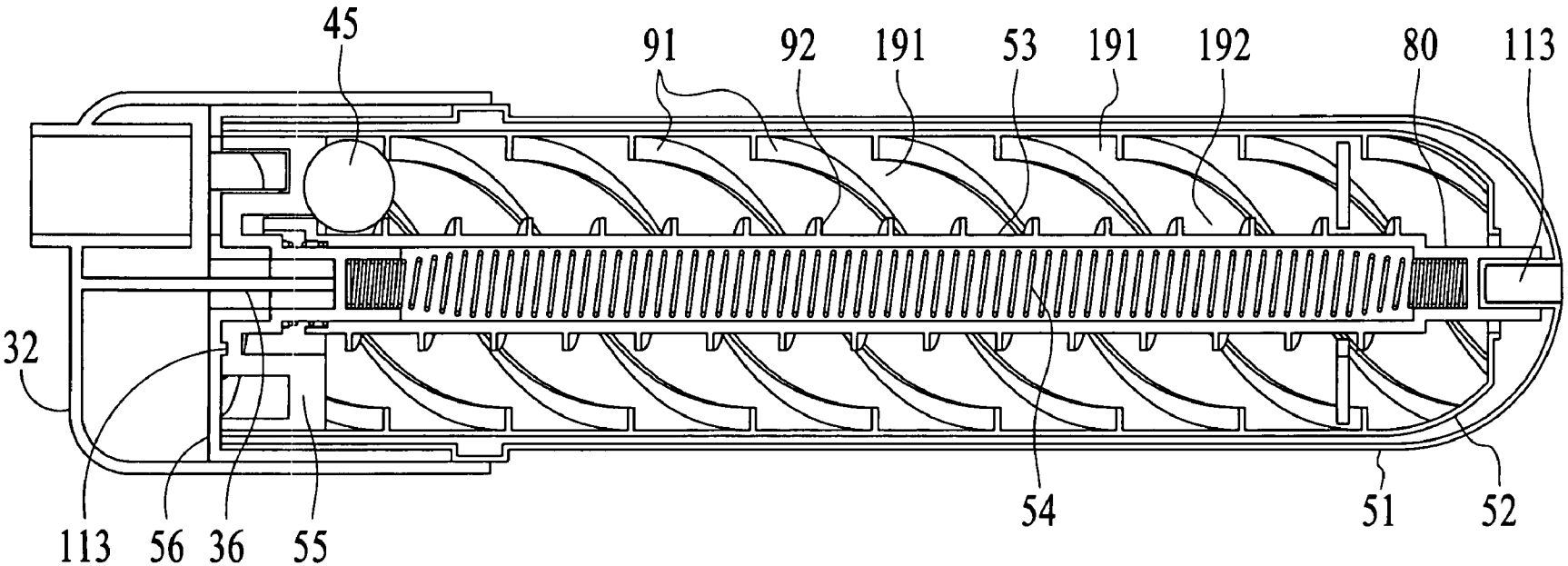
FIG. 11 and FIG. 12 are cut-away views illustrating operation of a paintball clip in accordance with an embodiment of the present invention.

FIG. 11 is a cut-away portion of paintball clip 33 and clip holder 32. Outer cap 56 is shown having been snapped over containment tube 51. Inner cap 55 is shown having been snapped within drive tube 52. Square end 59 of torsion spring 54 fits snugly within square shaft 60 of screw 53. A square feature 133 of containment tube 51 also fits snugly into square shaft 60 of screw 53. Square end 57 of torsion spring 54 fits snugly within square shaft 66 of inner cap 55.

Torsion spring 54 within screw 53 rotates inner cap 55 and drive tube 52 with respect to screw 53, outer cap 56 and containment tube 51. The six grooves 191 in drive tube 52 are aligned with the six flutes on inner cap 55.

Figure 12:
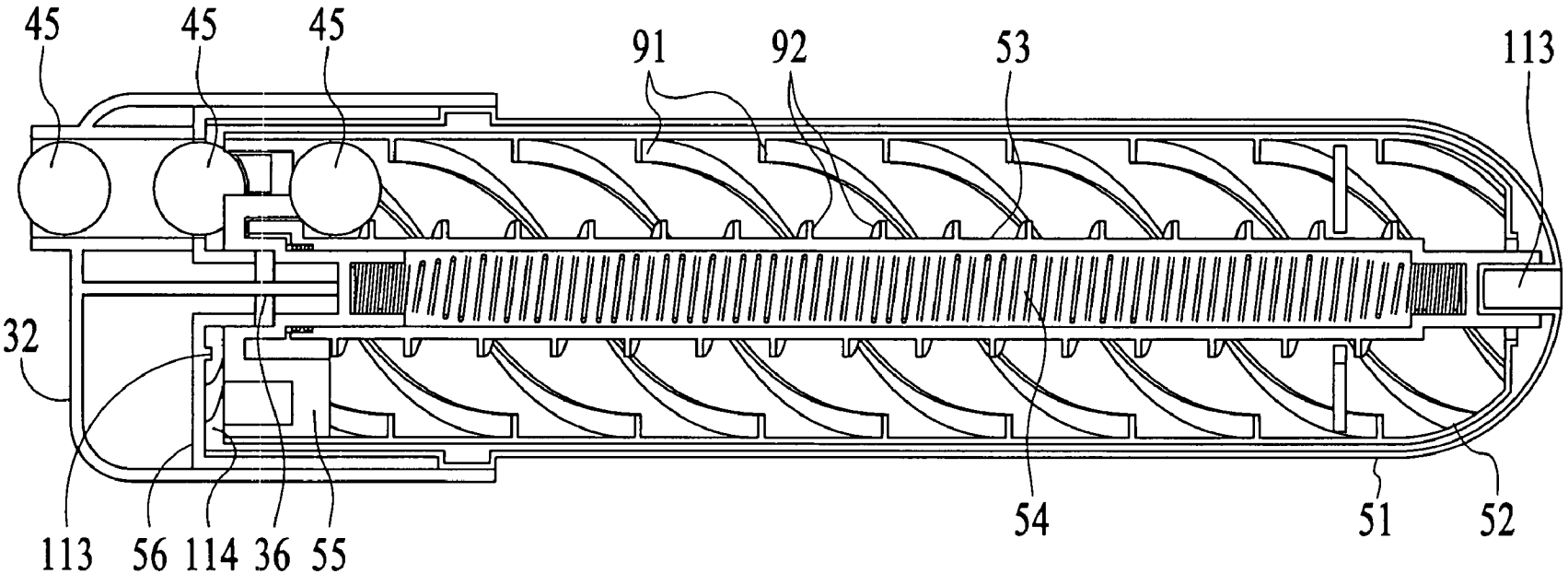

In FIG. 11, drive tube 52 is in a locked position with respect to containment tube 51. In the locked position a notch 113 of outer cap 56 is engaged. In FIG. 12, drive tube 52 is in an unlocked position with respect to containment tube 51. In the unlocked position, as evidenced by a space 114, drive tube 52 is pushed slightly deeper into containment tube 51, allowing drive tube 52 to allow rotation around pin 36 with respect to containment tube 51. In the unlocked position notch 113 of outer cap 56 is disengaged. Screw 53 rotates in synchronization with containment tube 51 so that the six grooves 191 are used to guide paintballs 45 along groove 192 of screw 53, allowing paintballs to exit drive tube 51.

Figure 13:
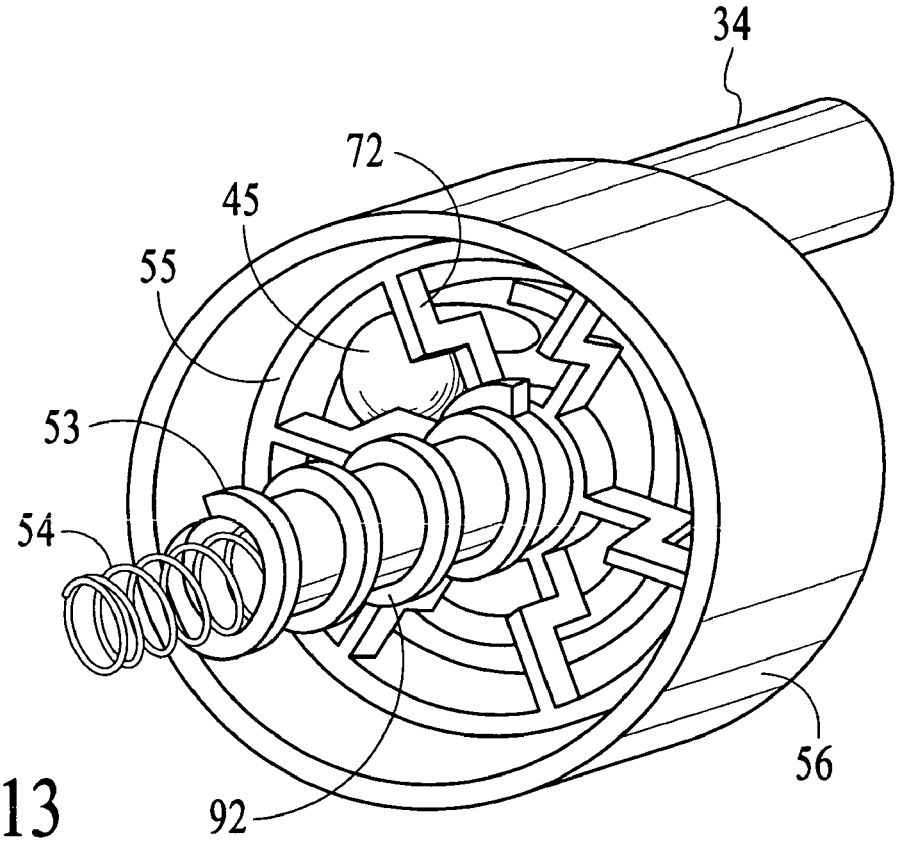
FIG. 13 is another cut-away view illustrating operation of a paintball clip in accordance with an embodiment of the present invention.

As shown in FIG. 13, the flutes bordered by ridges 72 guide paintballs 45 out holes 71 of inner cap 55, along ejection ramp 69, out of ejection hole 68 of outer cap 56 and into feed delivery tube 34.

Figure 14:
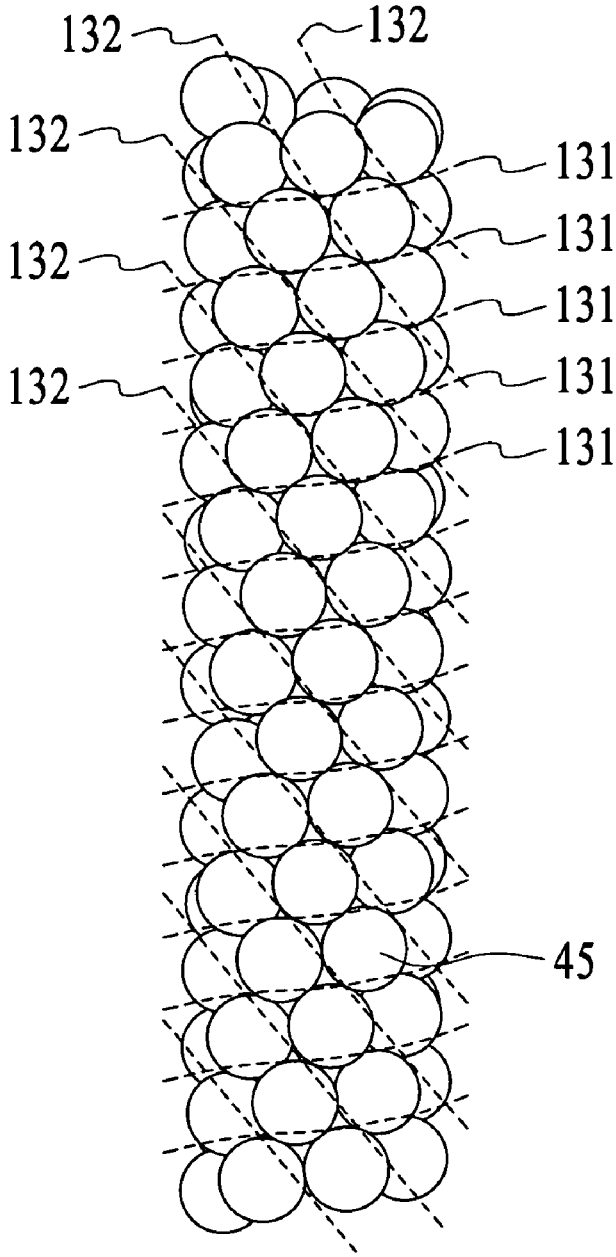
FIG. 14 shows a side view of a multiple helix arrangement of paintballs illustrating the way paintballs are stored in a paintball clip in accordance with an embodiment of the present invention.

FIG. 14 shows a side view of the multiple column arrangement of paintballs within paintball clip 33. Lines 131 represent the alignment of paintballs 45 along groove 192 of screw 53 (shown in FIG. 9). Lines 132 represent the alignment of paintballs 45 along grooves 191 of drive tube 52 (shown in FIG. 10).

Figure 15:
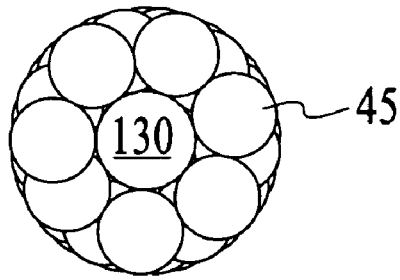
FIG. 15 shows a top view of the multiple helix arrangement of paintballs shown in FIG. 13 in accordance with an embodiment of the present invention.

FIG. 15 shows a top view of the multiple column arrangement of paintballs 45 within paintball clip 33. Hole 130 is the location of screw 53 in relation to the multiple column arrangement of paintballs 45.

The multiple column arrangement of paintballs 45 allows for a significantly reduced amount of work (distance times friction) as the balls travel through paintball clip 33. This is because, as paintballs 45 travel around groove 192 of screw 53, the paintballs are divided into six helical columns, divided by six grooves 191 that simultaneously advance paintballs 45 with respect to drive tube 52. As the paintballs 45 advance along the helix formed by ridge 92, paintballs 45 simultaneously advance along the six columns formed by grooves 191. The resulting shorter path paintballs 45 travel with respect to drive tube 52 results in minimal work (distance times friction) as paintballs 45 advance within drive tube 52.

Figure 16:
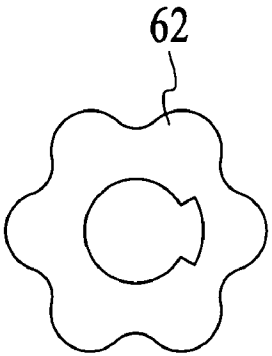
FIG. 16 shows a close-up of rotation limiter in accordance with an embodiment of the present invention.

FIG. 16 shows a close-up of rotation limiter 62.

Figure 17:
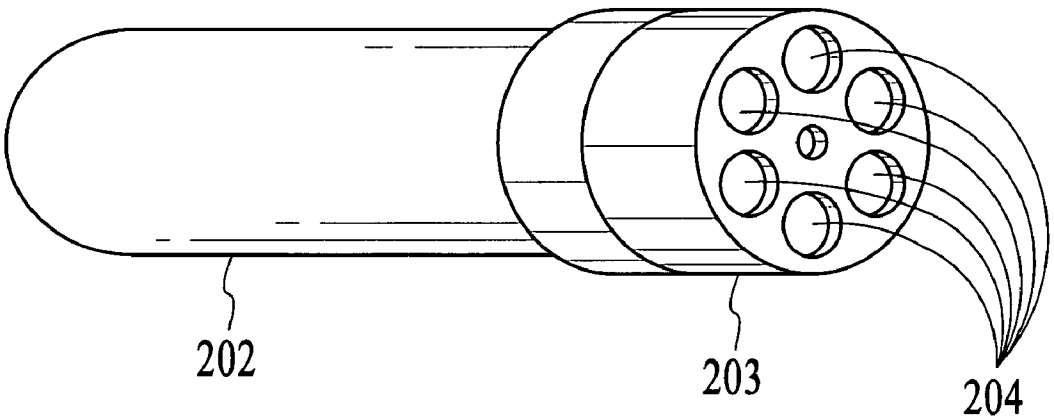
FIG. 17 shows an outer cap, fitted on a containment tube, having multiple ejection holes in accordance with an alternative embodiment of the present invention.

Various alternative embodiments of the invention can also be utilized. For example, instead of a single ejection hole in the outer cap, multiple ejection holes can be used. This is illustrated in FIG. 17 where an outer cap 203, fitted on a containment tube 202, has multiple ejection holes 204 which are used to eject paintballs.

Figure 18:
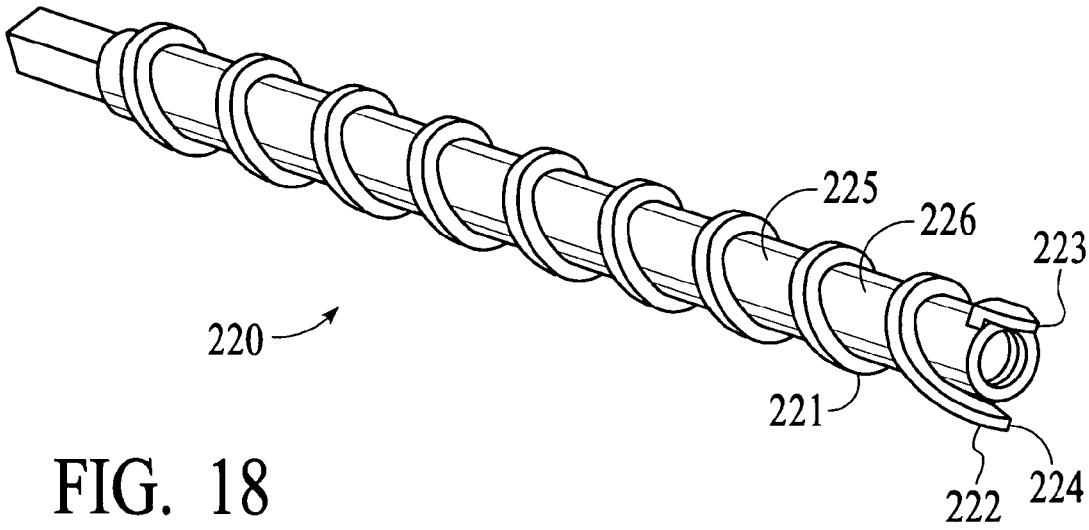
FIG. 18 shows a screw having multiple ridges in accordance with an alternative embodiment of the present invention.

For example, the screw can have multiple ridges and multiple grooves instead of a single ridge and a single groove. This is illustrated in FIG. 18 where a screw 220 is shown to have a ridge 221 with a ridge tip 223, and a ridge 222 with a ridge tip 224. Ridge 221 and ridge 222 form two separate grooves: a grove 225 and a groove 226.

Figure 19:
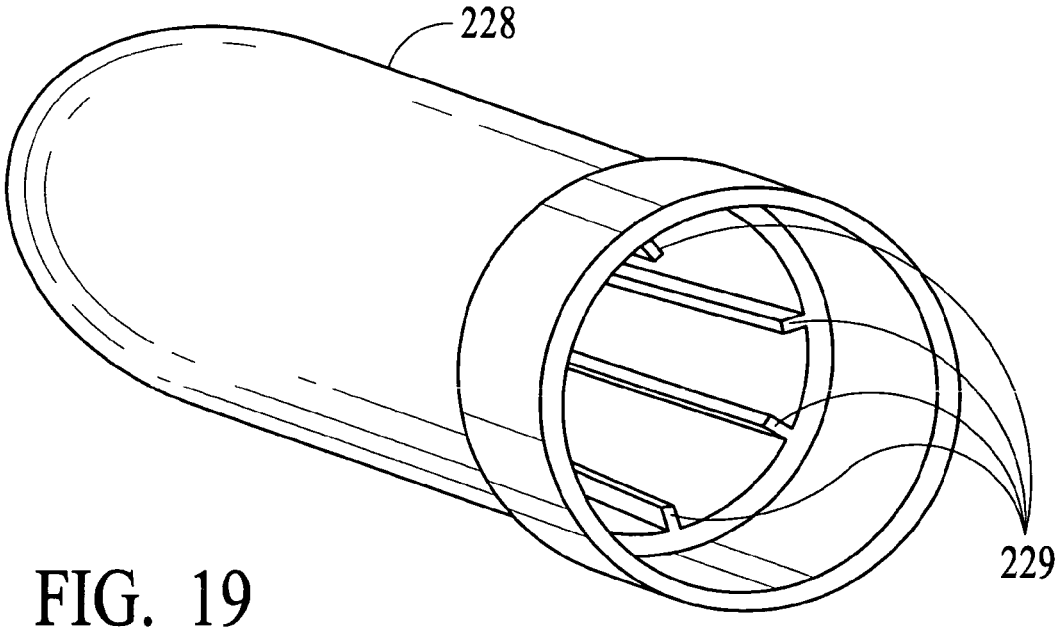
FIG. 19 shows a drive tube with straight ridges in accordance with an alternative embodiment of the present invention.

In another alternative embodiment of the present invention, the ridges of drive tube can be straight lines resulting in vertical columns. This is illustrated in FIG. 19 where ridges 221 of a drive tube 220 are straight. Nevertheless, in the embodiments, the ridges are helical in form as shown in FIG. 10. This allows for more efficient packing of paintballs 45 within paintball clip 33. Specifically, the slope of ridges 91 (shown in FIG. 10) on drive tube 52 is selected so that each row of paintballs 45 around ridge 92 interlocks with the previous row and the following row of paintballs around ridge 92. This can be seen in the resulting interlocking pattern of paintballs 45 shown in FIG. 13.

In other alternative embodiments, the containment tube can be eliminated and the screw can be rotated with respect to a drive tube having helical (or straight) grooves as described herein. It is intended that the statement "the screw rotates with respect to the drive tube" is equivalent to the statement "the drive tube rotates with respect to the screw".

Figure 20:
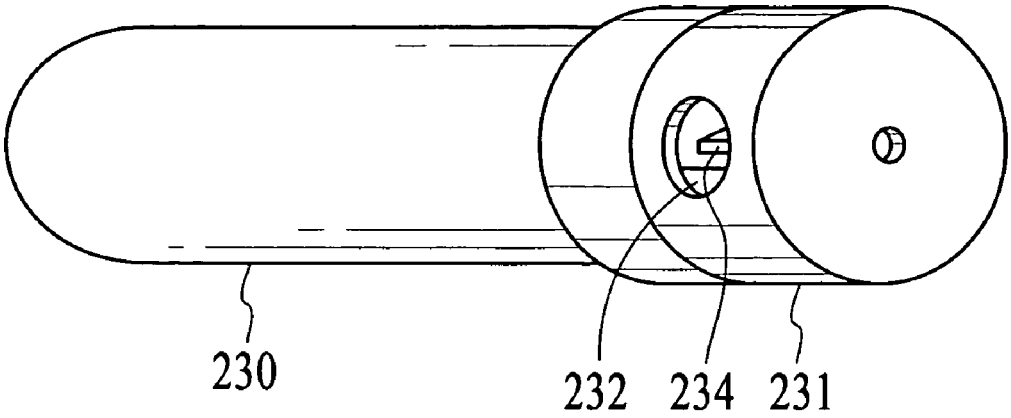
FIG. 20 shows an outer cap fitted on a containment tube and having an alternative ejection hole location in accordance with an alternative embodiment of the present invention.
Figure 21:
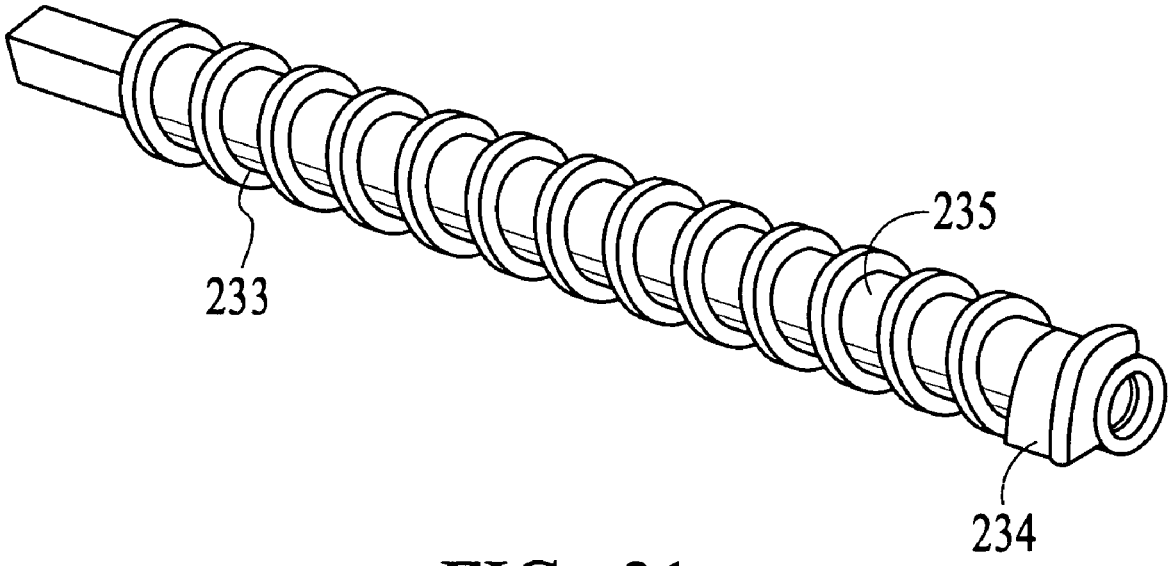
FIG. 21 shows a screw in accordance with an alternative embodiment of the present invention.
Figure 22:
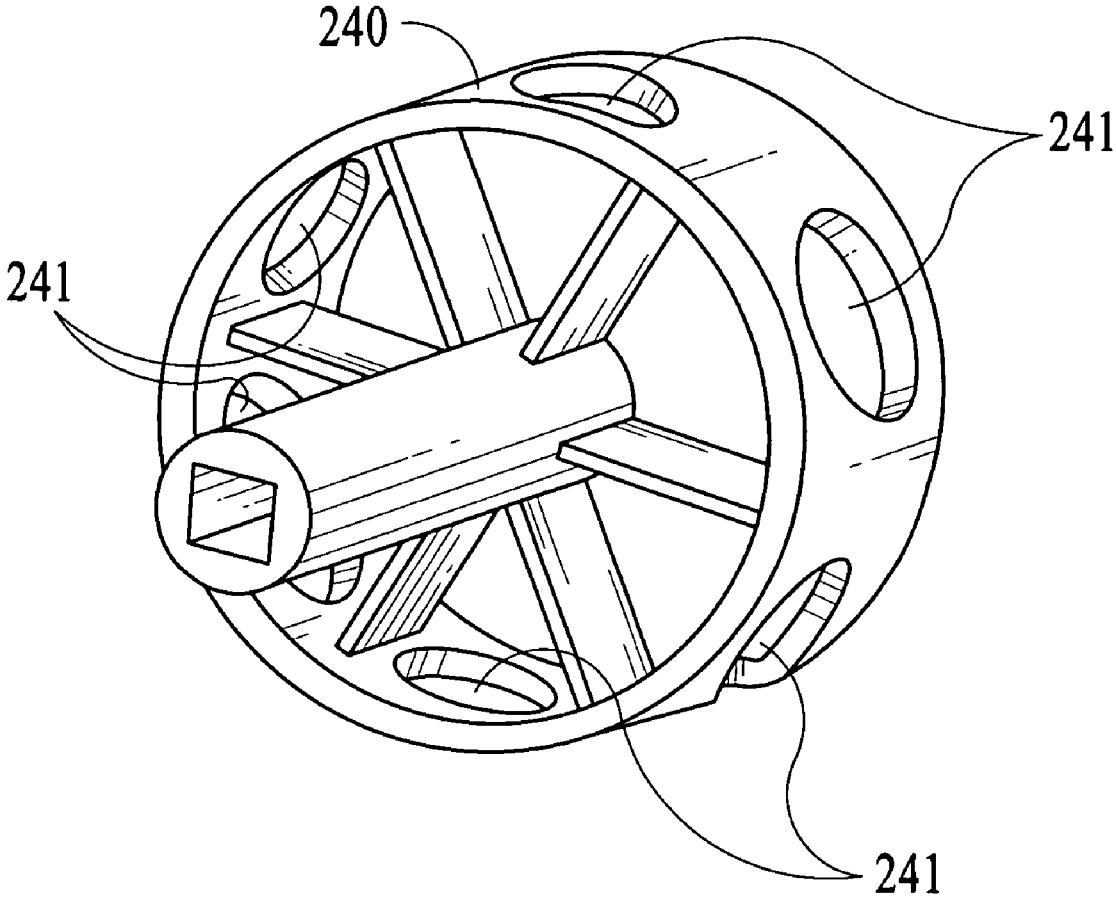
FIG. 22 shows an inner cap with multiple exit holes in accordance with an alternative embodiment of the present invention.

FIG. 20 shows an embodiment of the present invention with an outer cap 231 fitted over a containment tube 230. A drive tube (similar to drive tube 52 shown in FIG. 5) rotates with respect to a screw 233, shown in FIG. 21. An inner cap 240, shown in FIG. 22, has multiple exits holes 241. In this embodiment, paintballs travel along a groove 235 of screw 233, go up a ramp 234 and exit inner cap 240 through one of exit holes 241 and then exits outer cap 231 through a side hole 232.

Figure 24:
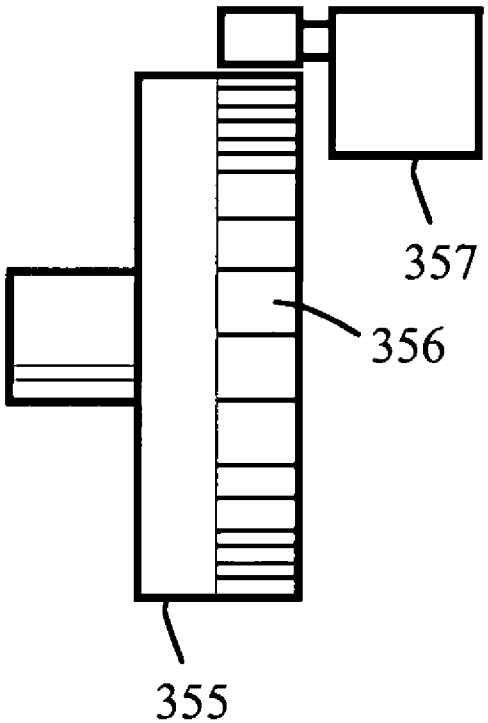
FIG. 24 shows a mechanical driver of an inner cap of a paintball loader in accordance with an embodiment of the present invention.
Figure 25:
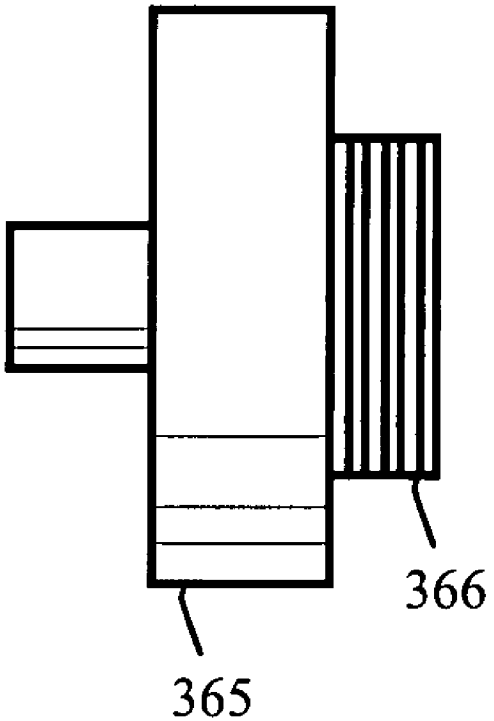
FIG. 25 shows a spring connected to an inner cap of a paintball loader in accordance with an embodiment of the present invention.

While in various embodiments of the present invention, a torsion spring is used to power rotation of the drive tube with respect to the screw, other devices can be used to provide power. For example, pressurized gas or an electric motor can be used to power rotation of the drive tube with respect to the screw. This is illustrated, for example, by FIG. 24. FIG. 24 shows an inner cap 355 (roughly equivalent in function to an inner cap 55 shown in FIG. 7), rotated by a motor 357 that engages grooves 356 on inner cap 355. Motor 357 is powered, for example by electricity or pressurized gas. The pressurized gas is provided, for example, by the paintball gun to which the paintball loader is attached. Electricity can be supplied, for example, through a battery. It is considered that powering rotation of the drive tube with respect to the screw is equivalent to powering rotation of the screw with respect to the drive tube. Alternatively, the power for rotation of the drive tube with respect to the screw can be supplied manually by a user.

FIG. 24 shows a spring 366 attached to an inner cap 365 and used to provide rotational power with respect to an outer cap of a containment tube.

The foregoing discussion discloses and describes merely exemplary methods and embodiments of the present invention. As will be understood by those familiar with the art, the invention may be embodied in other specific forms without departing from the spirit or essential characteristics thereof. For example, while the embodiment of the present invention is described with regard to loading paintballs into a paintball gun, the ideas presented can be used effectively for loading round objects into any type of device. Accordingly, the disclosure of the present invention is to be illustrative, but not limiting, of the scope of the invention, which is set forth in the following claims.

I claim:

1. A paintball loader that stores paintballs and loads paintballs into a paintball gun, the paintball loader comprising:

a screw having a plurality of helical grooves, the helical grooves winding in a first direction;

a drive tube having multiple column grooves on an inner surface of the drive tube, the screw being located within a center of the drive tube along a length of the drive tube so that paintballs loaded within the drive tube are each within one of the helical grooves of the screw and within one of the multiple column grooves on the inner surface of the drive tube;

wherein when the drive tube rotates with respect to the screw, paintballs within the drive tube are constrained to travel along one of the helical groove of the screw and along one of the multiple column grooves on the inner surface of the drive tube.

2. A paintball loader as in claim 1 wherein the multiple column grooves on the inner surface of the drive tube spiral around the inner surface of the drive tube.

3. A paintball loader as in claim 1 additionally comprising:

an attachment mechanism designed to attach the paintball loader to a paintball gun.

4. A paintball loader as in claim 1 wherein power for rotating the drive tube with respect to the screw is from pressurized gas supplied via a paintball gun.

5. A paintball loader as in claim 1 wherein power for rotating the drive tube with respect to the screw is from a torsion spring located within the screw.

6. A paintball loader as in claim 1 wherein power for rotating the drive tube with respect to the screw is from an electric motor.

7. A paintball gun comprising:

a paintball loader that stores paintballs, the paintball loader including:

a screw having a helical groove, the helical groove winding in a first direction, and a drive tube having multiple column grooves that spiral around an inner surface of the drive tube, the screw being located within a center of the drive tube along a length of the drive tube so that paintballs loaded within the drive tube are each within the helical groove of the screw and within one of the multiple column grooves on the inner surface of the drive tube; and, a paintball reception area for receiving paintballs from the paintball loader;

wherein when the drive tube rotates with respect to the screw, paintballs within the drive tube are constrained to travel along the helical groove of the screw and along one of the multiple column grooves on the inner surface of the drive tube.

8. A paintball gun as in claim 7 wherein the paintball loader is directly attached to the paintball reception area so that it is not necessary for paintballs to travel through a delivery tube in order to reach the paintball reception area.

9. A paintball gun as in claim 7 wherein the paintball loader is directly attached to the paintball reception area at a location underneath the paintball reception area.

10. A paintball gun as in claim 7 wherein power for rotating the drive tube with respect to the screw is from a torsion spring located within the screw.

11. A paintball gun as in claim 7 wherein power for rotating the drive tube with respect to the screw is supplied by pressurized gas.

12. A paintball gun as in claim 7 wherein power for rotating the drive tube with respect to the screw is supplied by an electric motor.

13. A method for loading paintballs into a paintball gun, comprising:

storing the paintballs within a drive tube of a paintball loader; and, loading the paintballs into the paintball gun from the drive tube of the paintball loader, including:

rotating a screw with respect to the drive tube so that the paintballs are constrained to travel along a helical groove of the screw and along one of multiple column grooves that spiral around an inner surface of the drive tube.

14. A method as in claim 13 wherein loading the paintballs into the paintball gun from the drive tube of the paintball loader includes forwarding the paintballs directly from the paintball loader to a paintball reception area of the paintball gun without the paintballs being required to travel through a delivery tube.

15. A method as in claim 14 wherein the paintball loader is directly attached to the paintball reception area at a location underneath the paintball reception area.

16. A method as in claim 13 wherein rotating the screw with respect to the drive tube includes supplying power, for rotating the screw with respect to the drive tube, from a torsion spring located within the screw.

17. A method as in claim 13 wherein rotating the screw with respect to the drive tube includes supplying power, for rotating the screw with respect to the drive tube, from pressurized gas.

18. A method as in claim 13 wherein rotating the screw with respect to the drive tube includes supplying power, for rotating the screw with respect to the drive tube, from an electric motor.

* * * * *